US006885140B2

(12) United States Patent
Etou

(10) Patent No.: US 6,885,140 B2
(45) Date of Patent: Apr. 26, 2005

(54) COLOR PICTURE TUBE

(75) Inventor: Hideaki Etou, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/301,386

(22) Filed: Nov. 20, 2002

(65) Prior Publication Data

US 2003/0102795 A1 Jun. 5, 2003

(30) Foreign Application Priority Data

Nov. 21, 2001 (JP) ..... 2001-355635

(51) Int. Cl.[7] ..... H01J 29/02; H01J 29/07
(52) U.S. Cl. ..... 313/404; 313/402; 313/407
(58) Field of Search ..... 313/402, 404, 313/406, 407

(56) References Cited

U.S. PATENT DOCUMENTS 5,914,557 A 6/1999 Tai et al.

FOREIGN PATENT DOCUMENTS

| | | | | |
|---|---|---|---|---|
| JP | 59-141150 | * | 8/1984 | ..... H01J/29/07 |
| JP | 9-82235 | | 3/1997 | |
| JP | 10-321153 | | 4/1998 | |

* cited by examiner

*Primary Examiner*—Nimeshkumar D. Patel
*Assistant Examiner*—Sharlene Leurig

(57) ABSTRACT

A color picture tube includes: a glass panel having a substantially rectangular-frame skirt; a rectangular frame holding a shadow mask; and a support spring elastically supporting the frame inside the skirt and fixed to a first position at inside surface of a long side of the skirt and to a second position at the facing outside surface of the frame. The first and second positions are away in horizontal axis direction perpendicular to tube axis and substantially parallel to the long side. The second position is more away from vertical axis perpendicular to tube axis and horizontal axis than the first position. Materials for the support spring and frame are selected so that, in horizontal axis direction, thermal expansion amount of the support spring between the first and second positions is substantially same as that of the frame between the second position and vertical axis when the tube is operated.

5 Claims, 12 Drawing Sheets

COLOR PICTURE TUBE

BACKGROUND OF THE INVENTION

1. Field of the Invention

The present invention relates to a color picture tube for use in a television set, a computer display, etc., and particularly to a fixing part for fixing a frame that holds a shadow mask to a glass panel.

2. Related Art

FIG. 1 is a front view of a conventional general color picture tube, cut on a plane that is perpendicular to its tube axis, so as to remove a front part of a glass panel.

As shown in FIG. 1, a frame 106 that holds a shadow mask 104 is elastically fixed, via three support springs 108, 110, and 112, to the inside of a skirt part 102 that is substantially in a rectangular frame-shape and that extends from a front part (not shown) of a glass panel 100. Hereafter in this specification, an axis that is perpendicular to the tube axis and is substantially parallel to a long side of the skirt part is assumed to be a horizontal axis (X axis), and an axis that is perpendicular to both the tube axis and the horizontal axis is assumed to be a vertical axis (Y axis).

The frame 106 is in a rectangular frame-shape and is smaller than the skirt part 102. The support springs 108 and 110 are bonded at its one ends by welding, respectively to two short sides of the frame 106, and the support spring 112 is bonded by welding at its one end, to one long side of the frame 106.

Each of the support springs 108, 110, and 112 is a long and narrow plate, and has an aperture (not shown) at its one end opposite to the end bonded by welding as described above. On the other hand, panel pins 114, 116, and 118 are provided at the inside surface of the skirt part 102 of the glass panel 100, so as to respectively correspond to the support springs 108, 110, and 112. By engaging the apertures of the corresponding support springs 108, 110, and 112 with the panel pins 114, 116, and 118, the frame 106 that holds the shadow mask 104 can be fixed to the inside of the glass panel 100.

There are several methods for arranging such panel pins that are used to fix a frame to the inside of a glass panel. The above-described method of using three pins is the simplest among all, and is typically employed for compact tubes of 21 inches (51 cm) or smaller. One reason for that is as follows. A shadow mask and a frame of such a compact color picture tube are small in size and weight. Therefore, even when the frame holding the shadow mask is fixed to a glass panel simply via three pins, the frame is not likely to be moved to a wrong position with respect to the glass panel in a drop test of the color picture tube.

In a rectangular area of the shadow mask 104 indicated by reference numeral 120, a large number of regularly arranged holes are formed. On the other hand, a phosphor screen formed by regularly arranging red, green, and blue phosphor dots is provided at the inner surface of the front part of the glass panel 100. At the back in the paper, an electron gun (not shown) is provided, and three electron beams emitted from the electron gun are sorted by the holes formed in the shadow mask 104, so that each electron beam hits a phosphor dot of its targeted color.

Here, a ratio of the electron beams passing through the holes is usually as small as 15 to 25%. A large portion of the electron beams collides with solid parts (non-hole parts) of the shadow mask. As a result, heat is generated in the shadow mask, and the generated heat is conducted to the frame, the support springs, and the panel pins in the stated order, thereby causing thermal expansion of each of these components.

Such thermal expansion further causes the holes of the shadow mask 104 to be moved from the correct positions. Along with this, the landing positions on the phosphor screen at which the electrons beams hit are deviated from the correct landing positions. In this specification, the phenomenon that the actual landing positions of the electron beams on the phosphor screen are deviated from the correct landing positions is referred to as "mislanding". Also, an amount by which the actual landing positions are deviated from the correct landing positions is referred to as a "mislanding amount".

Along with the increased electron beam current due to higher brightness of color picture tubes, the above-described phenomenon of "mislanding" has become a serious problem in recent years.

For example, an amount of electron beam current is increased due to the following settings often employed in recent years. For computer display monitors, the operating conditions may often be set such that the display is in a reverse-mode where a background of a display screen is white, brightness of the center of the display screen is as high as 100 cd/cm$^2$, and the display size is "full scan".

As a result, it has been extremely difficult to prevent mislanding caused by thermal expansion occurring in a greater scale than thermal expansion occurring in conventional cases, even if an INVAR material ("INVAR" is a trademark) having a low thermal expansion coefficient is employed for a shadow mask. Such a phenomenon occurs that the shadow mask is moved unsymmetrically in the left-right direction with respect to the Y axis at the time of entire doming. The mislanding causes such problems as degradation in brightness of the display screen due to the degraded luminous efficiency of the phosphors, and deterioration in the while color uniformity on the display screen.

In view of these problems, a technique is proposed for reducing the mislanding by employing the structure where a welding spot at which the shadow mask and the frame are welded together is set away from the central axis of the shadow mask (see Japanese Laid-open Patent Application No. H10-321153). With this technique, however, the effect of reducing the mislanding can be obtained only in the vicinity of the welding spot that is set away from the shadow mask central axis. In other words, this technique fails to achieve corrections on the entire phosphor screen.

SUMMARY OF THE INVENTION

The present invention aims at providing a color picture tube with a lowered maximum value for a mislanding amount, and with improved left-right asymmetry of mislanding.

The above aim of the present invention can be achieved by a color picture tube, including: a glass panel that has a skirt part being in a substantially rectangular frame-shape; a frame that holds a shadow mask at an inside thereof, the frame being in a substantially rectangular shape; and a support spring that elastically supports the frame at an inside of the skirt part, the support spring being fixed to (a) a first position that is at an inside surface of a long side of the skirt part, and to (b) a second position that is at an outside surface of a side of the frame facing the long side of the skirt part, the first position and the second position being away from each other in a direction of a horizontal axis, the second position being more away from a vertical axis than the first position, the horizontal axis being perpendicular to a tube axis of the color picture tube and being substantially parallel to the long side, the vertical axis being perpendicular to both the tube axis and the horizontal axis, wherein materials for the support spring and the frame are selected so that, in the direction of the horizontal axis, a thermal expansion amount of the support spring between the first position and the second position is substantially same as a thermal expansion amount of the frame between the second position and the vertical axis when the color picture tube is operated.

The above aim of the present invention can also be achieved by a color picture tube, including: a glass panel that has a skirt part being in a substantially rectangular frame-shape; a frame that holds a shadow mask at an inside thereof, the frame being in a substantially rectangular shape; and a support spring that elastically supports the frame at an inside of the skirt part, the support spring being fixed to (a) a first position that is at an inside surface of a long side of the skirt part, and to (b) a second position that is at an outside surface of a side of the frame facing the long side of the skirt part, the first position and the second position being away from each other in a direction of a horizontal axis, the second position being more away from a vertical axis than the first position, the horizontal axis being perpendicular to a tube axis of the color picture tube and being substantially parallel to the long side, the vertical axis being perpendicular to both the tube axis and the horizontal axis, wherein the first position is set so that, in the direction of the horizontal axis, a thermal expansion amount of the support spring between the first position and the second position is substantially same as a thermal expansion amount of the frame between the second position and the vertical axis when the color picture tube is operated.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENTS

The following describes preferred embodiments of the present invention, taking a 17-inch (41 cm) color picture tube with a deflection angle of 100° as example, with reference to the drawings.

(First Embodiment)

Figure 1:
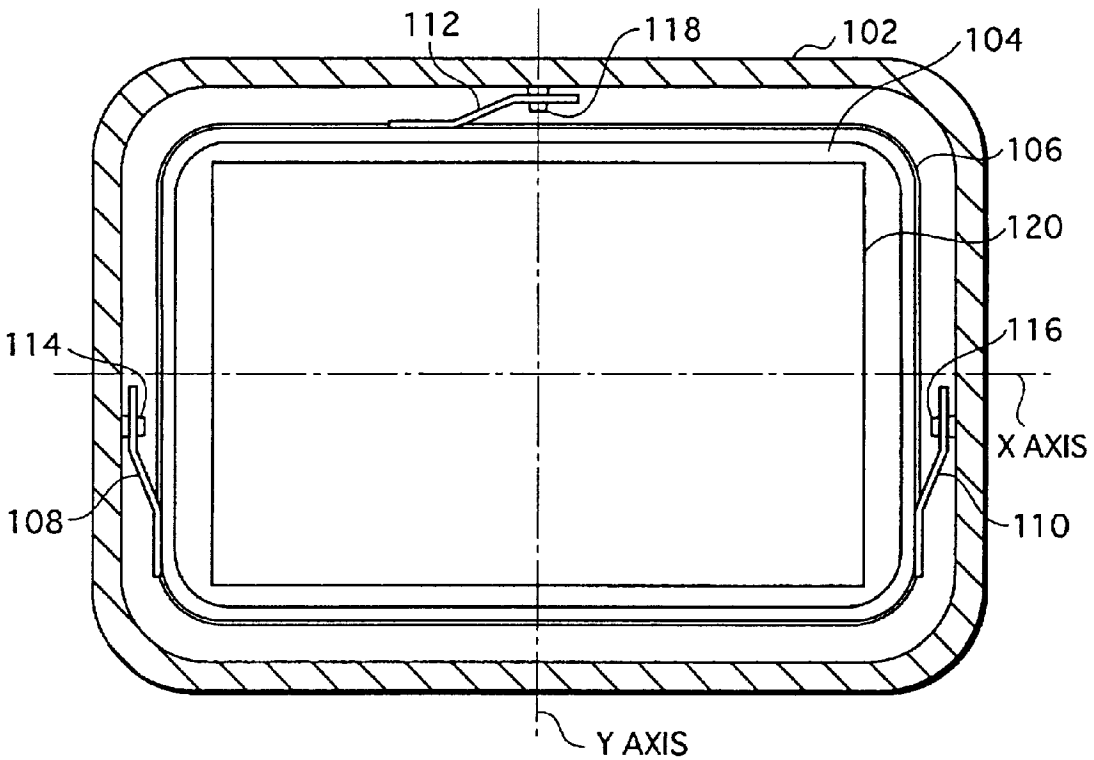
FIG. 1 PRIOR ART
FIG. 1 is a front view of a conventional color picture tube, cut on a plane perpendicular to its tube axis, so as to remove a front part of a glass panel.
Figure 2:
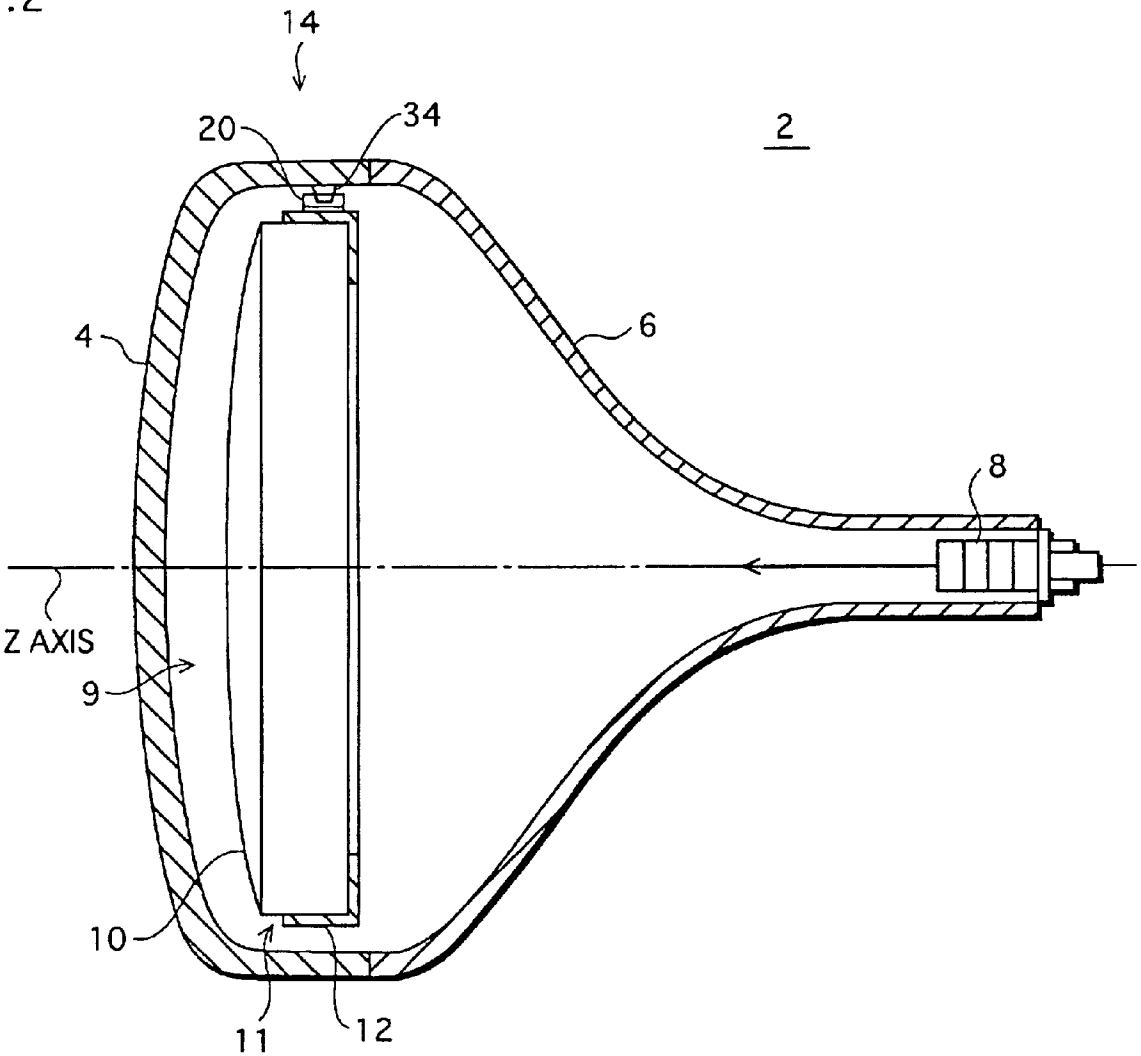
FIG. 2 is a sectional view of a color picture tube according to a first embodiment of the present invention, taken on a vertical plane that includes a tube axis of the color picture tube.

FIG. 2 is a sectional view of a color picture tube 2 according to a first embodiment of the present invention, taken on a vertical plane that includes its tube axis (Z axis).

The color picture tube 2 includes a glass panel 4 on whose inner surface a phosphor screen (not shown) formed by regularly applying phosphor dots of three colors is provided, a funnel 6 that constitutes a part of a vacuum tube container together with the glass panel 4, an electron gun 8 that is provided in a neck of the funnel 6, a shadow mask 10, and a frame 12 that holds the shadow mask 10.

The shadow mask 10 is positioned between the electron gun 8 and the phosphor screen in close proximity to the phosphor screen. The shadow mask 10 has a large number of holes (not shown) that are regularly arranged therein, and plays a role in sorting colors of three electron beams emitted from the electron gun 8. The shadow mask 10 includes a front part 9 that is a spherical-surface (or a flat-surface) part thereof, and a skirt part 11 that extends from the front part 9 as being folded at a periphery of the front part 9. The skirt part 11 is bonded by welding to the frame 12 at positions inside the frame 12 that are described later, thereby constructing an assembly of the shadow mask and the frame.

Figure 3:
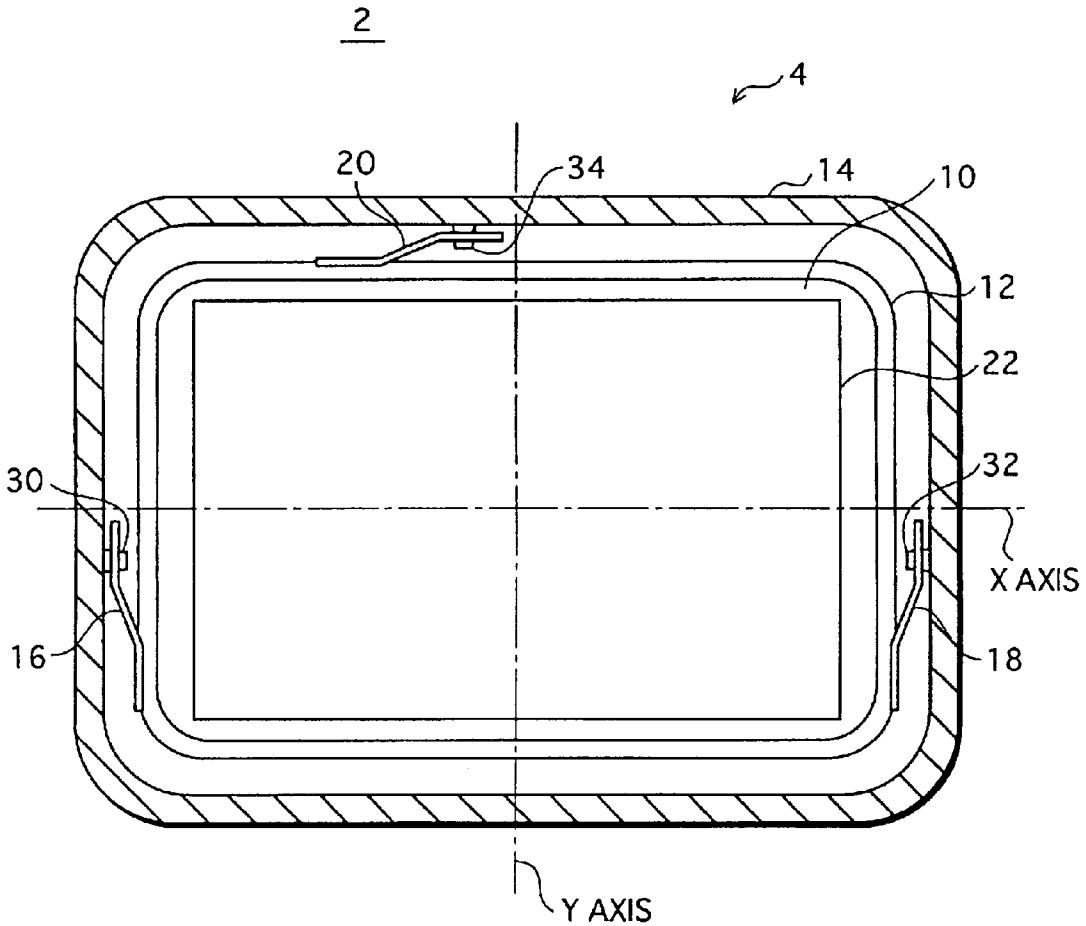
FIG. 3 is a front view of the color picture tube according to the first embodiment, cut on a plane perpendicular to its tube axis, so as to remove a front part of a glass panel.

FIG. 3 is a front view of the color picture tube 2, cut on a plane perpendicular to its tube axis, so as to remove the front part of the glass panel 4. As shown in FIG. 3, the frame 12 that is in a rectangular frame-shape and is smaller than the skirt part 14 is elastically fixed, via three support springs 16, 18, and 20, to the inside of the skirt part 14 that is substantially in a rectangular frame-shape. Here, as described above, the axis that is perpendicular to the tube axis (Z axis) and is substantially parallel to a long side of the skirt part 14 is assumed to be the horizontal axis (X axis), and the axis that is perpendicular to both the tube axis and the horizontal axis is assumed to be the vertical axis (Y axis). In FIG. 3, dashed lines indicate the X axis and the Y axis. It should be noted here that a rectangular area of the shadow mask 10 indicated by reference numeral 22 in FIG. 3 is a perforated area where holes are formed. The frame 12 and the skirt part 11 of the shadow mask 10 are spot-welded at eight spots in total, namely, two spots that intersect with the Y axis, two spots that intersect with the X axis, and four spots at the four corners.

The support springs 16, 18, and 20 each are a long and narrow plate. One end of each support spring is bonded to the frame 12 by welding, and an aperture (not shown in FIG. 3) is formed at the other end of each support spring. The support springs 16, 18, and 20 are substantially in the same shape, and so only the support spring 20 that is bonded to the long side of the frame 12 is shown in FIG. 4 as viewed from its thickness direction.

Figure 4:
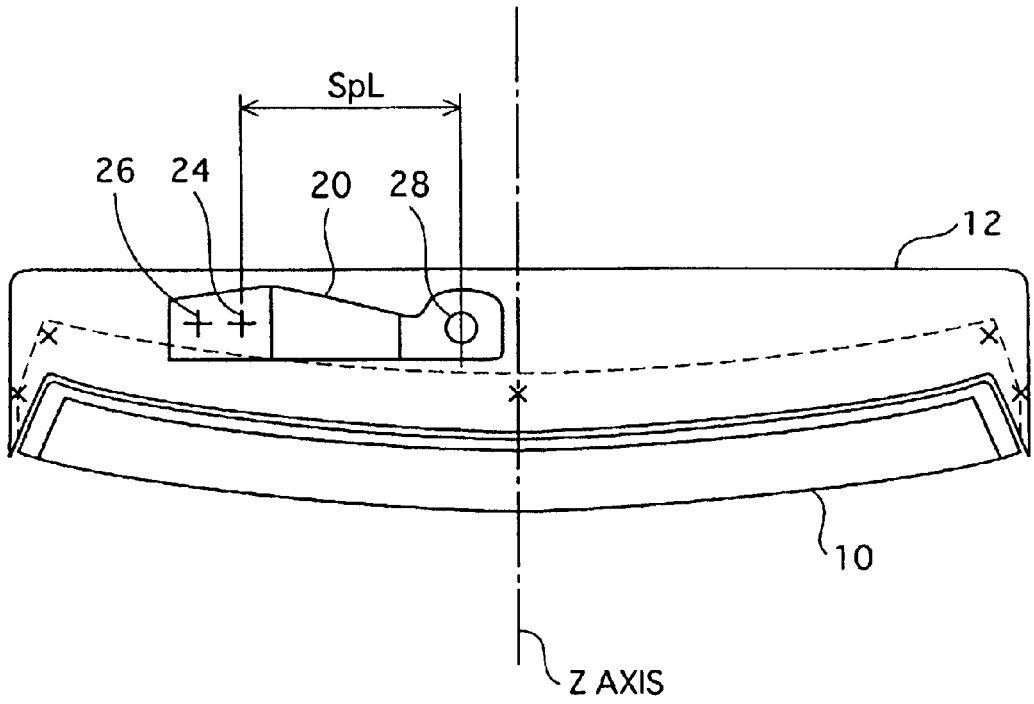
FIG. 4 is a plan view of a frame that holds a shadow mask, with a support spring being bonded to a long side of the frame, in the color picture tube according to the first embodiment.

FIG. 4 is a plan view of the frame 12 that holds the shadow mask 10, with the support spring 20 being bonded thereto.

As shown in FIG. 4, the support spring 20 is spot-welded to the frame 12 at two welding spots 24 and 26 indicated by the symbol "+". At the other end of the support spring 20 opposite to the welding, an aperture 28 is provided. The welding state and the position of the aperture for the support springs 16 and 18 bonded to the short sides of the frame 12 are the same as those described for the support spring 20. Here, in the support spring 20, a distance in the X axis direction between the center of the aperture 28 and the welding spot 24 that is a closer one to the aperture 28 is referred to as a "support span", and is expressed using "SpL". It should be noted here that the symbol "x" in FIG. 4 indicates the above-described welding spots of the frame 12 and the shadow mask 10.

Referring back to FIG. 3, panel pins 30, 32, and 34 each being in a cone trapezoid shape are fixed to the inside surface of the skirt part 14 of the glass panel 4, so as to respectively correspond to the support springs 16, 18, and 20. By engaging the apertures of the corresponding support springs 16, 18, and 20 with the panel pins 30, 32, and 34, the frame 12 can be fixed to the glass panel 4.

The frame 12 being fixed to the glass panel 4 is symmetrically positioned with respect to the Y axis at room temperature. To be more specific, the frame 12 being fixed to the glass panel 4 is positioned so that an axis that equally divides the frame 12 into two (left and right) parts (hereafter referred to as a "frame central axis") substantially matches the Y axis.

The following gives dimensions, materials, etc., for the components of the above construction.

The glass panel 4 has a long side of 369.2 mm and a short side of 293.4 mm. The shadow mask 10 has, at its outside surface, a long side of 331.2 mm and a short side of 255. 2 mm. The panel pin 34 is provided at such a position where its center is 10.0 mm away from the Y axis to the left. The panel pins 30 and 32 are provided at such positions where their centers are 20.0 mm away from the X axis downward. The support springs 16, 18, and 20 each have a plate thickness of 0.8 mm and an average plate width of 12 mm, with the support span "SpL" being 52.2 mm. The apertures of the support springs 16, 18, and 20 respectively being engaged with the panel pins 30, 32, and 34 each in a cone trapezoid shape are at such positions where the diameter of the panel pins 30, 32, and 34 is 5.61 mm.

The shadow mask 10 is made of INVAR that is a low thermal expansion metal (with a thermal expansion coefficient of $10\times10^{-7}/°$ C.). The INVAR is an alloy of Fe 60% and Ni 36%, and is also referred to as invariable steel. The frame 12 is made of low-carbon steel (with a thermal expansion coefficient of $117\times10^{-7}/°$ C.). The support springs 16, 18, and 20 are made of stainless steel SUS304 (with a thermal expansion coefficient of $171\times10^{-7}/°$ C.). It should be noted here that SUS304 is a material specified by the JIS (Japanese Industrial Standards). The glass panel 4 is made of glass (with a thermal expansion coefficient of $99\times10^{-7}/°$ C.). It should be noted here that the above-described materials for those components are generally selected as materials for the corresponding conventional components.

Next, the following describes the principle for causing mislanding, and the principle on which the mislanding amount is reduced in the first embodiment as compared with a conventional case.

Three electron beams emitted from the electron gun 8 are magnetically deflected, and then pass through the holes formed in the shadow mask 10. The ratio at which the electron beams pass through the holes is usually in a range of 15 to 25% as described above. This means that a large portion of the electron beams collides with non-hole parts of the shadow mask 10, thereby heating the shadow mask 10.

The heat generated in the shadow mask 10 at the time of operating the color picture tube is conducted to the frame 12, the support springs 16, 18, and 20, the panel pins 30, 32, and 34, and the glass panel 4 in the stated order, thereby causing thermal expansion of each of these components. Due to a different thermal expansion coefficient of each of these components, an amount of thermal expansion in the horizontal axis direction (left-right direction) differs depending on each component. This causes left-right asymmetry of the mislanding amount at the time of entire doming.

Figure 5:
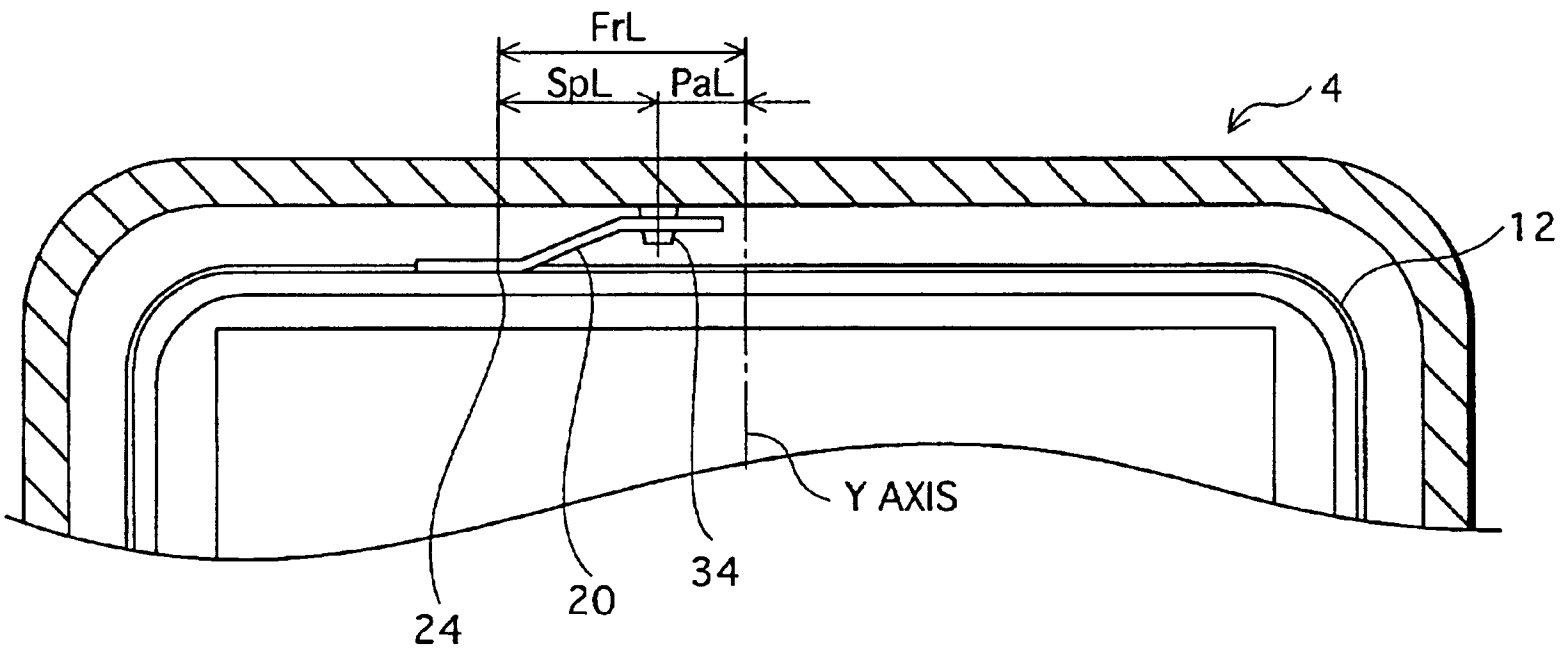
FIG. 5 is a partial enlarged front view of the color picture tube according to the first embodiment, cut on the plane perpendicular to its tube axis, so as to remove the front part of the glass panel.

The amounts of thermal expansion occurring in these components (the support spring 20, the frame 12, and the glass panel 4) are respectively written as the expressions (1) to (3) below. It should be noted here that a variable in each expression indicates a length shown in FIG. 5.

Expression (1)

$$Sp\Delta X=Sp\alpha\times Sp\Delta T\times SpL$$

where "SpΔX" is a thermal expansion amount of the support spring 20, "Spα" is a thermal expansion coefficient of the support spring 20, "SpΔT" is a temperature change of the support spring 20, and "SpL" is the support span at room temperature.

Expression (2)

$$Fr\Delta X=Fr\alpha\times Fr\Delta T\times FrL$$

where "FrΔX" is a thermal expansion amount of the frame 12, "Frα" is a thermal expansion coefficient of the frame 12, "FrΔT" is a temperature change of the frame 12, and "FrL" is the distance from the Y axis to the welding spot 24 at room temperature.

Expression (3)

$$Pa\Delta X=Pa\alpha\times Pa\Delta T\times PaL$$

where "PaΔX" is a thermal expansion amount of the glass panel 4, "Paα" is a thermal expansion coefficient of the glass panel 4, "PaΔT" is a temperature change of the glass panel 4, and "PaL" is the distance from the Y axis to the center of the panel pin 34 at room temperature.

Then, a balance "ΔΔX" of the thermal expansion amounts of these components at the time of operating the color picture tube, i.e., a deviation amount "ΔΔX" by which the frame central axis is deviated with respect to the Y axis in the horizontal axis (X axis) direction is written as the expression (4).

Expression (4)

$$\Delta\Delta X=(Sp\Delta X+Pa\Delta X)-Fr\Delta X$$

Based upon the expressions (1) to (4), the following first describes the deviation amount "ΔΔX" in the case of a conventional color picture tube having the panel pin 118 on the Y axis.

Figure 6:
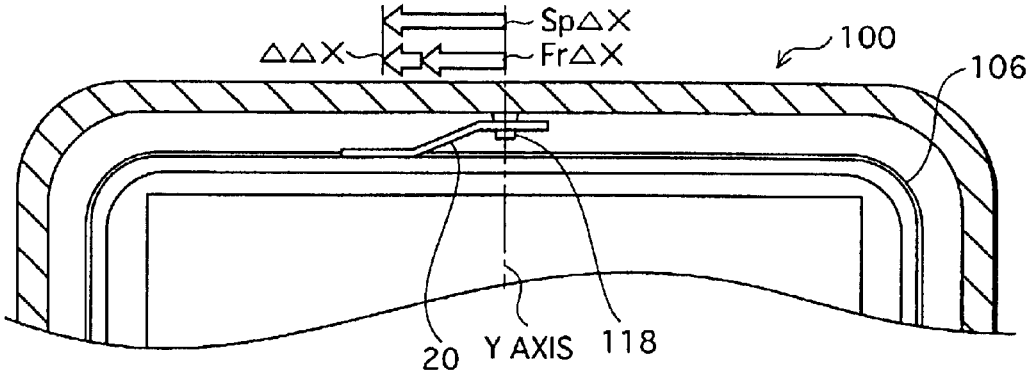
FIG.6 PRIOR ART
FIG. 6 is a partial front view of the conventional color picture tube, cut on the plane perpendicular to its tube axis, so as to remove the front part of the glass panel.

FIG. 6 schematically shows the relationship among the thermal expansion amounts of these components at the time of operating the conventional color picture tube. Arrows in the figure represent the thermal expansion amounts of these components. It should be noted here that these arrows are greatly enlarged for ease of explanation. With the panel pin 118 being on the Y axis, PaL=0. Then, using the expression (3), PaΔX=0. Using the expression (4), therefore, ΔΔX=SpΔX−FrΔX.

Figure 7:
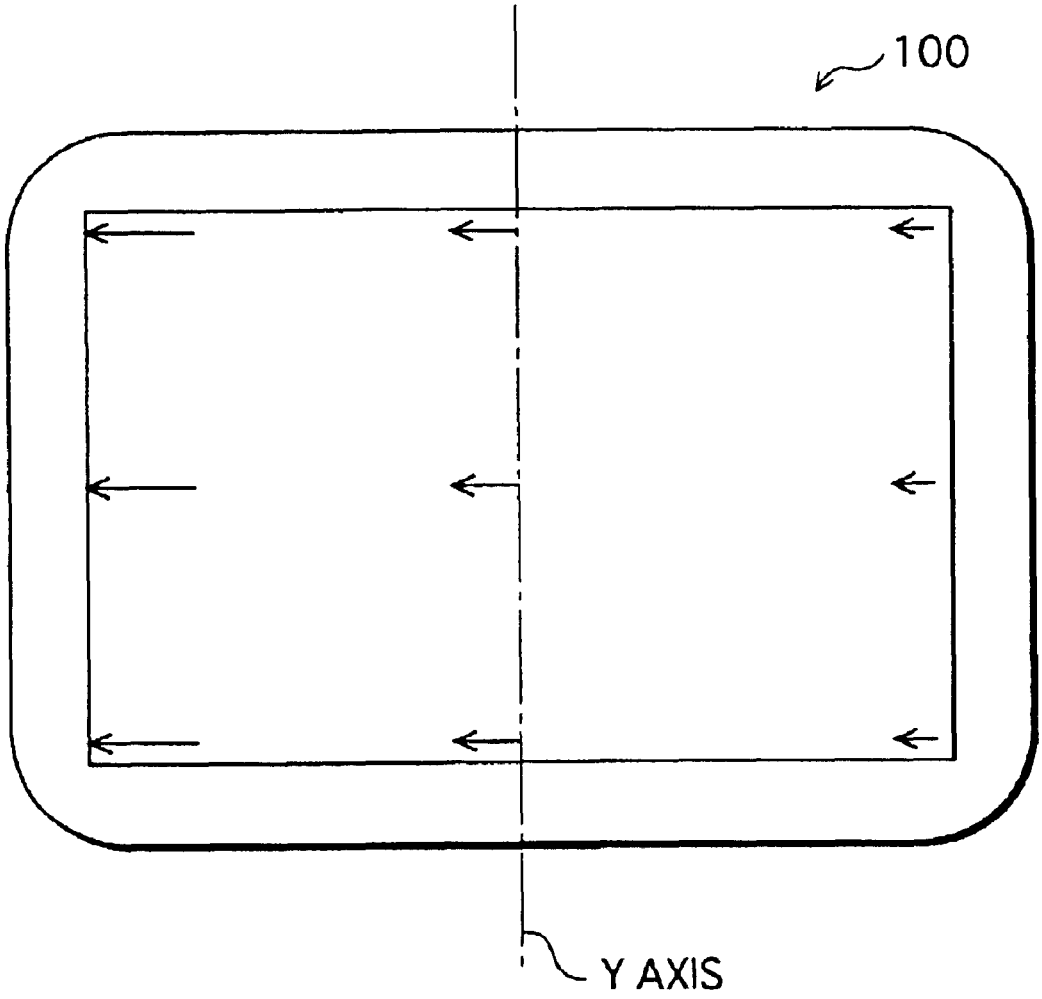
FIG.7 PRIOR ART
FIG. 7 shows the state of mislanding occurring in the conventional color picture tube.

FIG. 7 shows the landing state on the entire phosphor screen in this case. In FIG. 7, a rectangular area of the glass panel 100 indicates the phosphor screen, where the direction and the amount of mislanding are respectively indicated by the orientation and the length of each arrow. The frame 106 itself is expanded uniformly to the left and to the right with respect to the frame central axis. The support spring 112 with a high thermal expansion coefficient is expanded to the left. As a result, the frame 106 as a whole is moved toward the left. Accordingly, the frame central axis is deviated from the Y axis to the left. Along with this, the landing positions of the electron beams are entirely deviated to the left from the correct landing positions.

The following describes the case of the first embodiment. As described above, the panel pin 34 is provided at a position that is away from the Y axis to the left in the first embodiment. Also, the support span of the support spring for the color picture tube 2 according to the first embodiment is the same as that for the conventional color picture tube. As a result, the distance "FrL" in the color picture tube 2 according to the first embodiment is longer than that in the conventional color picture tube.

Figure 8:
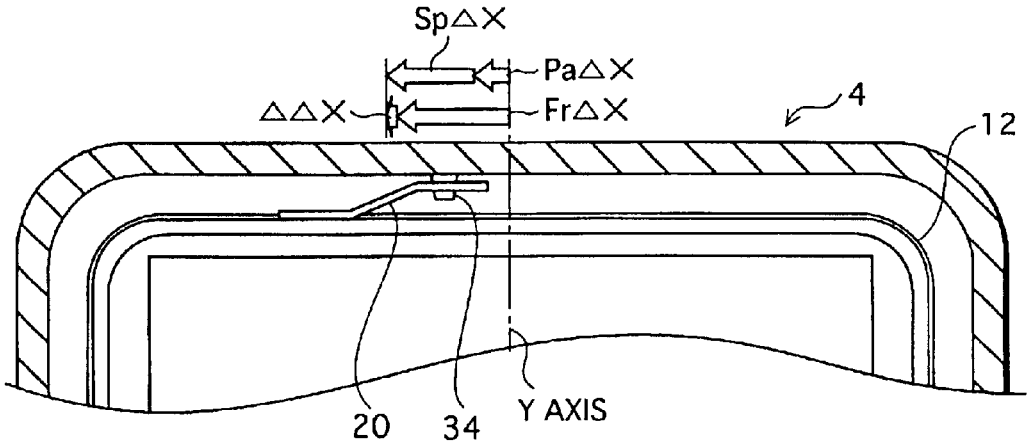
FIG. 8 is a partial front view of the color picture tube according to the first embodiment, cut on the plane perpendicular to its tube axis, so as to remove the front part of the glass panel.

FIG. 8 schematically shows the relationship among the thermal expansion amounts of the components in the first embodiment. The distance "FrL" of the frame 12 having a low thermal expansion coefficient is set longer than the support span of the support spring 20 having a high thermal expansion coefficient. Due to this, as shown in FIG. 8, the thermal expansion amount "SpΔX" of the support spring 20 is the same as that in the conventional color picture tube, but the thermal expansion amount "FrΔX" of the frame 12 is larger than that in the conventional color picture tube. It should be noted here that because the glass panel 4 has a low thermal expansion coefficient and moreover shows a modest temperature increase, the thermal expansion amount "PaΔX" is relatively small and is substantially negligible.

Figure 9:
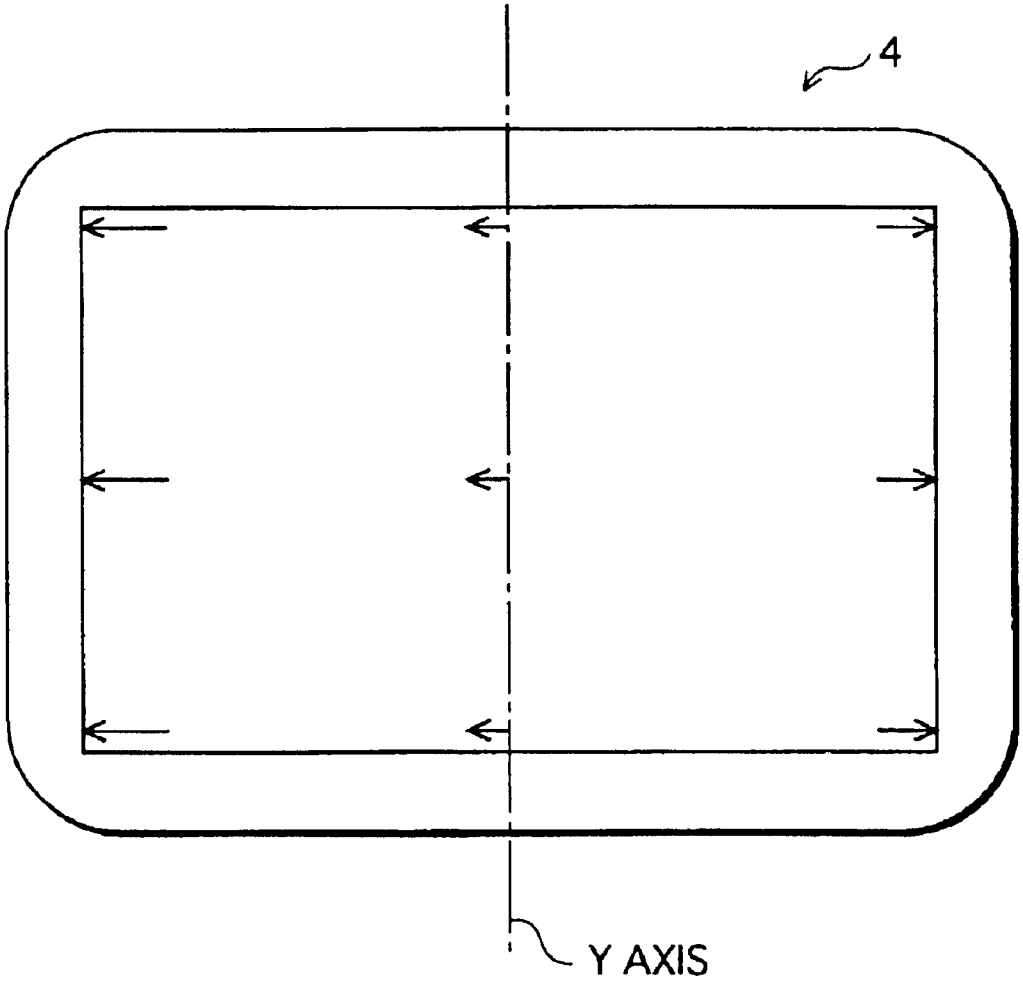
FIG. 9 shows the state of mislanding occurring in the color picture tube according to the first embodiment.

According to the above-described relationship, the balance of the thermal expansion amounts in the horizontal direction obtained using the expression (4) "ΔΔX=(SpΔX+Pa ΔX)−FrΔX" is improved as compared with the case of the conventional color picture tube. FIG. 9 shows the mislanding state on the entire phosphor screen in this case. In particular, the mislanding amount is close to zero on the Y axis. Also, the mislanding is occurring in the right direction at the right end of the phosphor screen. Further, the mislanding amount at the right end of the phosphor screen is substantially the same as the mislanding amount at the left end of the phosphor screen. This means that the left-right asymmetry of the mislanding amount at the time of entire doming is reduced.

By optimizing the fixing positions of the components, and the conditions of the components including the thermal expansion coefficient, the deviation amount "ΔΔX" can be made even zero. The deviation amount "ΔΔX" being zero means that the frame central axis and the Y axis can be kept matching even at the time when the color picture tube is operated.

The distance by which the panel pin 34 provided on the long side is away from the Y axis is to be determined by considering various factors, namely, the support span of the support spring 20, the thermal expansion coefficient of the frame 12, the thermal expansion coefficient of the support spring 20, the thermal expansion coefficient of the glass panel 4, and a difference in the temperature rise of each of these components during operation of the color picture tube.

(Second Embodiment)

A color picture tube according to a second embodiment of the present invention has basically the same construction as the color picture tube according to the first embodiment, with the differences being in the position of a panel pin provided on a long side of a glass panel, a material for a support spring to be engaged with the panel pin, and the fixing position (welding position of a frame) of the support spring in the horizontal axis (X axis) direction. Accordingly, components in the present embodiment that are the same as the components in the first embodiment are given the same reference numerals as before, and are not described in the present embodiment. The present embodiment is described focusing only on these differences.

Figure 10:
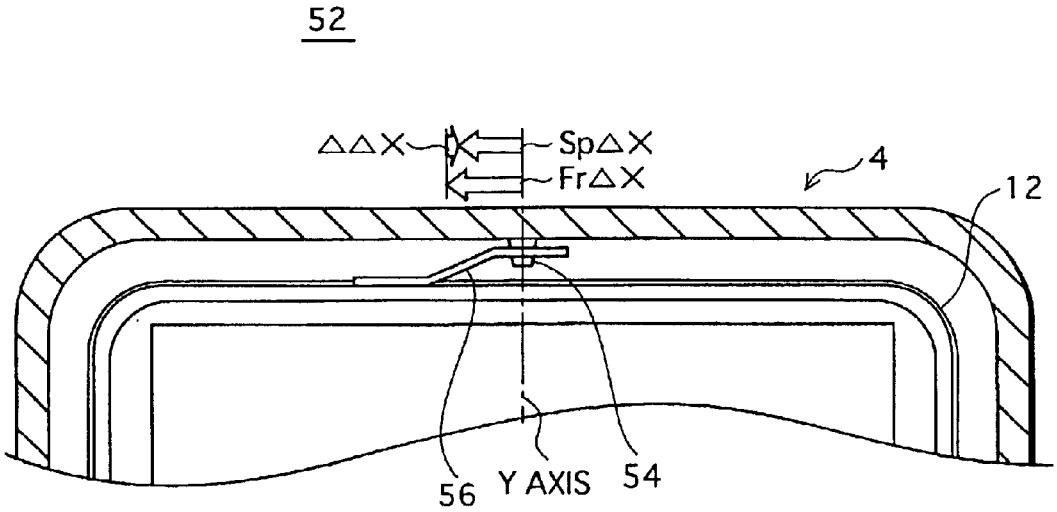
FIG. 10 is a partial front view of a color picture tube according to a second embodiment of the present invention, cut on a plane perpendicular to its tube axis, so as to remove a front part of a glass panel.

FIG. 10 is a partial front view showing only an upper part of the color picture tube 52 according to the second embodiment, cut on a plane perpendicular to its tube axis to remove a front part of the glass panel 4.

In the second embodiment, the center of the panel pin 54 is positioned on the Y axis unlike in the first embodiment. To be more specific, the position of the panel pin 54 in the second embodiment is the same as in the case of a conventional color picture tube. The difference between the color picture tube according to the present embodiment and the conventional color picture tube lies in a material for the support spring 56, i.e., a thermal expansion coefficient of the support spring 56. The support spring 56 is made of stainless steel SUS420J29 (with a thermal expansion coefficient of $100\times10^{-7}$), in view of making the thermal expansion coefficient of the support spring substantially the same as the thermal expansion coefficient of the frame 12 (with a thermal expansion coefficient of $117\times10^{-7}$). It should be noted here that SUS420J29 is a material specified by the JIS.

Figure 11:
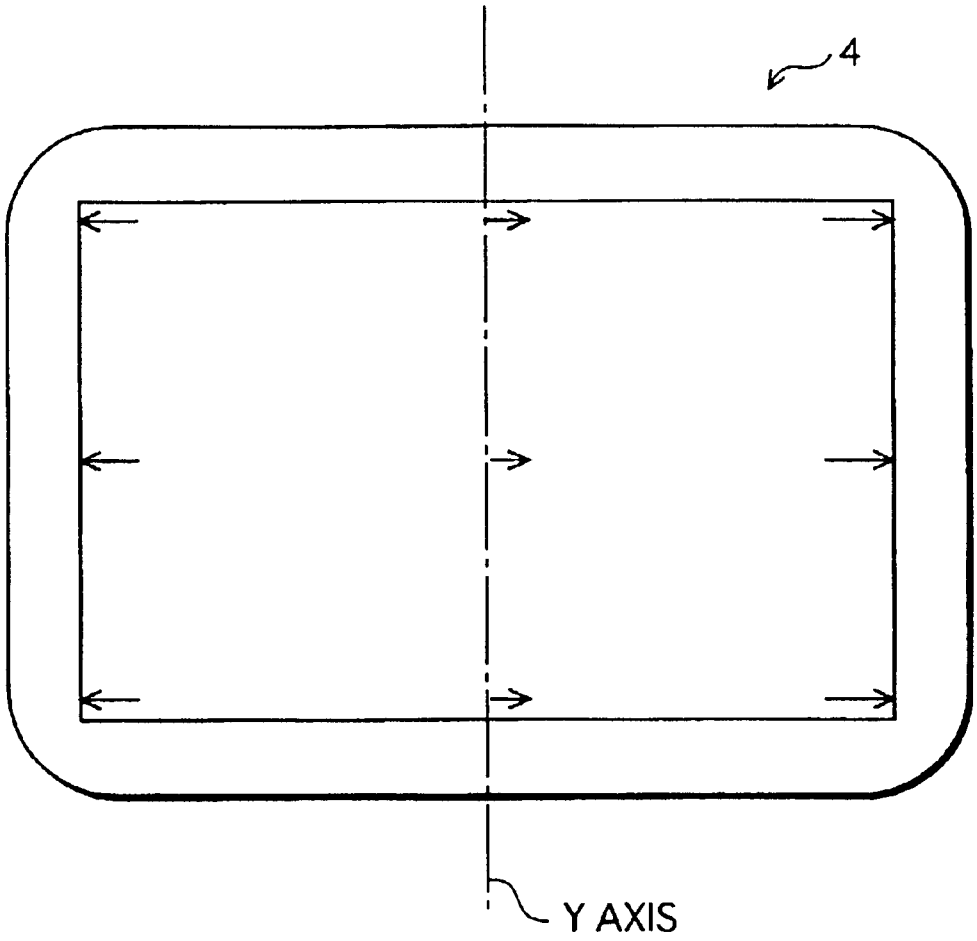
FIG. 11 shows the state of mislanding occurring in the color picture tube according to the second embodiment.

By making the thermal expansion coefficient "Spα" of the support spring 56 lower than that of a conventional one, the thermal expansion amount "SpΔX" of the support spring 56 can be made smaller. As a result, the balance of the thermal expansion amounts in the horizontal direction that is obtained using the expression (4) "ΔΔX=SpΔX−FrΔX (note here that PaΔX=0)" can be improved. Therefore, the asymmetry of the mislanding in the left-right direction can be improved. FIG. 11 shows the state of mislanding on the entire phosphor screen in this case.

The following should be noted here. The temperature increase in the frame 12 is larger than the temperature increase in the support spring. Assume here that the support spring and the frame 12 are made from materials having completely the same thermal expansion coefficient. In this case, the mislanding amount on the entire phosphor screen suffers from the left-right asymmetry. Therefore, it is preferable that the support spring is made from a material having a little higher thermal expansion coefficient than a material for the frame 12.

Alternatively, a material having a lower thermal expansion coefficient than a material for the frame may be used for the support spring. In this case, the panel pin is to be provided at a position that is away from the Y axis to the right. For example, in the case of the second embodiment, too, the thermal expansion coefficient ($100\times10^{-7}$/° C.) of the support spring 56 is substantially the same as the thermal expansion coefficient ($117\times10^{-7}$/° C.) of the frame 12. To be more precise, however, the thermal expansion coefficient of the support spring 56 is a little lower than the thermal expansion coefficient of the frame 12. In view of this little difference, the panel pin 54 may be provided at such a position that is away from the Y axis direction to the right by a distance corresponding to this difference. It should be noted here that the welding spot of the support spring to the frame (the fixing position of the support spring to the frame) is of course never positioned at the right side with respect to the Y axis. It should also be noted here that the welding spot of the support spring to the frame (the fixing position of the support spring to the frame) is positioned at least more away from the Y axis than the panel pin 54.

(Confirmation of the Effects)

The following describes results of an experiment carried out using the color picture tube 2 according to the first embodiment, for the purpose of examining the effects produced by reduced mislanding.

The experiment was conducted under the operations conditions of:

anode voltage "Va"=26 kV;

anode current "Ia"=600 μA;

scanning the entire phosphor screen (100% scan); and displaying the entire display screen as white.

The mislanding amount in the horizontal direction was measured using a measurement apparatus (LND-060-1P manufactured by LINK SEED SYSTEM INC.) at nine positions on the display screen. The nine positions are: one point at the center of the display screen; two points positioned 150 mm away from the tube axis (Z axis) to the left and to the right in the X axis direction; two points positioned 115 mm away from the tube axis (Z axis) upward and downward in the Y axis direction; and four points positioned respectively at four corners that are 190 mm away from an intersection of the tube axis and the diagonal axis.

Figure 12:
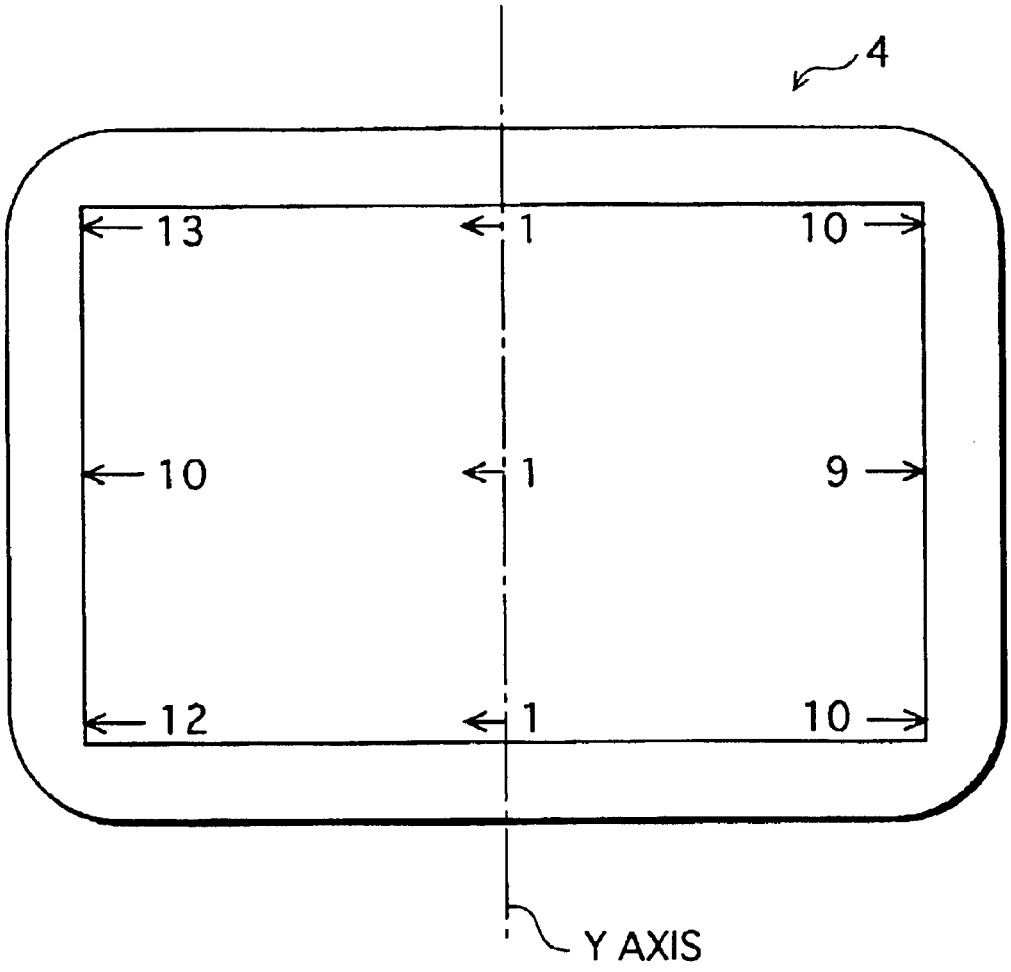
FIG. 12 shows a mislanding amount in the color picture tube according to the first embodiment.

FIG. 12 shows the direction and the amount of mislanding measured two hours after the start of the operation where the entire doming was supposedly stabilized. Numerical values shown in FIG. 12 indicate the landing amount at the nine positions in the unit of "μm". As shown in FIG. 12, the mislanding amount is lm on the Y axis, 10 to 13 μm at the left end of the phosphor screen, and 9 to 10 μm at the right end of the phosphor screen. According to these numerical values, the mislanding amount is close to zero at the center part of the phosphor screen, and also, the mislanding amount is substantially uniform at the left end and the right end of the phosphor screen. This means that the left-right asymmetry of the mislanding is reduced. According to an evaluation method unique to the inventor, the left-right asymmetry of mislanding in the color picture tube 2 according to the first embodiment at the time of entire doming is "left: 1.0 μm", whereas the left-right asymmetry of mislanding in the conventional color picture tube under the same measurement conditions is "left: 4.3 μm". This is equivalent to the effect that the color picture tube 2 according to the first embodiment exhibits a decrease of 77% in the mislanding amount as compared with the conventional color picture tube.

Further, as for the decrease in the uniformity of brightness on the entire phosphor screen, the conventional color picture tube exhibits brightness at a periphery of the phosphor screen being 9% lower than brightness at its central part due to the mislanding at the time of entire doming. On the other hand, the color picture tube 2 according to the first embodiment exhibits improved brightness at a periphery of the phosphor screen of only 5% lower than brightness at its central part.

Further, it was confirmed that the maximum mislanding amount was reduced in an external magnetic test that is usually performed at the time of products' shipment. The external magnetic test aims at checking interference by the earth magnetism. In the external magnetic test, an external magnetic field was generated in the tube axis direction within the color picture tube that was made to display a single color, and then irregular color generated due to the mislanding was checked. Then, the intensity of the external magnetic field was set at various values, and the degree of irregular color generated at each external magnetic field intensity was measured. The intensity of the external magnetic field at which the allowable maximum irregular color was generated (hereafter referred to as "allowed magnetic field intensity" was used for the evaluation. According to the results of the external magnetic test, the allowed magnetic field intensity for the conventional color picture tube was 30 μT, whereas the allowed magnetic field intensity for the color picture tube in the first embodiment was improved to 40 μT. This indicates that irregular color in the color picture tube according to the first embodiment can be fallen within an allowable range even when the magnetic field of 40 μT is applied in the tube axis direction.

Although the present invention is described based on the above embodiments, the present invention should not be specifically limited to the above embodiments.

In particular, the position of the panel pin provided on the long side of the skirt part of the glass panel, the support span of the support spring bonded to the long side of the frame, the material (thermal expansion coefficient) selected for the frame, and the material (thermal expansion coefficient) selected for the support spring should not be limited to the values and materials specifically disclosed in the above embodiments.

Assume here that the position of the panel pin, i.e., the fixing position of the support spring to the skirt part is a first position, and the position of the welding spot of the support spring and the frame closer to the panel pin, i.e., the fixing position of the support spring to the frame is a second position. The first position and the second position, and the materials (thermal expansion coefficient) for the frame and the support spring can be determined freely in such a manner that the thermal expansion amount of the support spring in the horizontal axis (X axis) direction between the first and second positions is substantially the same as the thermal expansion amount of the frame in the horizontal axis direction between the second position and the vertical axis (Y axis).

By doing so, an influence by the thermal expansion of the support spring can be eliminated, and so the frame central axis does not deviate from the Y axis in the X axis direction even at the time of operating the color picture tube. In other words, both end parts of the frame in the X axis direction are moved outward with respect to the Y axis, in the horizontal axis direction. Here, each of the end parts of the frame is moved by substantially the same distance.

As a result, in the color picture tube of the present invention, the holes formed in the shadow mask that is bonded to the frame by welding are moved in the same way as the frame is moved. Therefore, the maximum value for the mislanding amount can be lowered as compared with the conventional color picture tube, and also, the left-right asymmetry of mislanding can be improved.

Also, although the above embodiments describe the case where the support spring bonded to the long side of the frame is fixed in such a manner that its welding spot to the frame is positioned at the left side with respect to the panel pin as viewed from the front of the color picture tube, the support spring may be fixed in the reversed orientation. To be more specific, the welding spot of the support spring and the frame may be positioned at the right side with respect to the panel pin, as viewed from the front of the color picture tube.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A color picture tube, comprising:

a glass panel that has a skirt part being in a substantially rectangular frame-shape;

a frame that holds a shadow mask at an inside thereof, the frame being in a substantially rectangular shape; and a support spring that elastically supports the frame at an inside of the skirt part, the support spring being fixed to (a) a first position that is at an inside surface of a long side of the skirt part, and to (b) a second position that is at an outside surface of a side of the frame facing the long side of the skirt part, the first position and the second position being away from each other in a direction of a horizontal axis, the second position being more away from a vertical axis than the first position, the horizontal axis being perpendicular to a tube axis of the color picture tube and being substantially parallel to the long side, the vertical axis being perpendicular to both the tube axis and the horizontal axis, wherein materials for the support spring and the frame are selected so that, in the direction of the horizontal axis, a thermal expansion amount of the support spring between the first position and the second position is substantially same as a thermal expansion amount of the frame between the second position and the vertical axis when the color picture tube is operated, wherein the first position is on the vertical axis, and the materials for the support spring and the frame are selected so that a difference between a thermal expansion coefficient of the support spring and a thermal expansion coefficient of the frame is in such a range that causes both end parts of the frame in the direction of the horizontal axis to be moved outward with respect to the vertical axis, in the direction of the horizontal axis, when the color picture tube is operated, each of the end parts being moved by substantially a same distance.

2. The color picture tube of claim 1, wherein stainless steel having a thermal expansion coefficient of $100\times10^{-7}/°$ C. is selected as the material for the support spring, and low-carbon steel having a thermal expansion coefficient of $117\times10^{-7}/°$ C. is selected as the material for the frame.

3. A color picture tube, comprising:

a glass panel that has a skirt part being in a substantially rectangular frame-shape;

a frame that holds a shadow mask at an inside thereof, the frame being in a substantially rectangular shape; and a support spring that elastically supports the frame at an inside of the skirt part, the support spring being fixed to (a) a first position that is at an inside surface of a long side of the skirt part, and to (b) a second position that is at an outside surface of a side of the frame facing the long side of the skirt part, the first position and the second position being away from each other in a direction of a horizontal axis, the second position being more away from a vertical axis than the first position, the horizontal axis being perpendicular to a tube axis of the color picture tube and being substantially parallel to the long side, the vertical axis being perpendicular to both the tube axis and the horizontal axis, wherein materials for the support spring and the frame are selected so that, in the direction of the horizontal axis, a thermal expansion amount of the support spring between the first position and the second position is substantially same as a thermal expansion amount of the frame between the second position and the vertical axis when the color picture tube is operated, wherein the first position and the second position are at a same side in the direction of the horizontal axis, with respect to the vertical axis, and the materials for the support spring and the frame are selected so that a thermal expansion coefficient of the support spring is higher than a thermal expansion coefficient of the frame to such a degree that causes both end parts of the frame in the direction of the horizontal axis to be moved outward with respect to the vertical axis, in the direction of the horizontal axis, each of the end parts being moved by substantially a same distance.

4. A color picture tube, comprising:

a glass panel that has a skirt part being in a substantially rectangular frame-shape;

a frame that holds a shadow mask at an inside thereof, the frame being in a substantially rectangular shape; and a support spring that elastically supports the frame at an inside of the skirt part, the support spring being fixed to (a) a first position that is at an inside surface of a long side of the skirt part, and to (b) a second position that is at an outside surface of a side of the frame facing the long side of the skirt part, the first position and the second position being away from each other in a direction of a horizontal axis, the second position being more away from a vertical axis than the first position, the horizontal axis being perpendicular to a tube axis of the color picture tube and being substantially parallel to the long side, the vertical axis being perpendicular to both the tube axis and the horizontal axis, wherein the first position is set so that, in the direction of the horizontal axis, a thermal expansion amount of the support spring between the first position and the second position is substantially same as a thermal expansion amount of the frame between the second position and the vertical axis when the color picture tube is operated, wherein the first position is away by a predetermined distance from the vertical axis in the direction of the horizontal axis, the predetermined distance being such that causes both end parts of the frame in the direction of the horizontal axis to be moved outward in the direction of the horizontal axis, each of the end parts being moved by substantially a same distance.

5. The color picture tube of claim 4, wherein the first position is at a same side as the second position in the direction of the horizontal axis, with respect to the vertical axis.

* * * * *